US010400437B2

(12) United States Patent
Haughton et al.

(10) Patent No.: US 10,400,437 B2
(45) Date of Patent: Sep. 3, 2019

(54) BALCONY

(71) Applicant: SAPPHIRE BALLUSTRADES LTD, Reading Berkshire (GB)

(72) Inventors: Nick Haughton, Reading Berkshire (GB); Tristan Parsons, Reading Berkshire (GB)

(73) Assignee: SAPPHIRE BALCONIES LIMITED, Reading, Berkshire (GB)

( * ) Notice: Subject to any disclaimer, the term of this patent is extended or adjusted under 35 U.S.C. 154(b) by 0 days.

(21) Appl. No.: 14/919,210

(22) PCT Filed: Apr. 22, 2014

(86) PCT No.: PCT/GB2014/051240
§ 371 (c)(1),
(2) Date: Oct. 21, 2015

(87) PCT Pub. No.: WO2014/174269
PCT Pub. Date: Oct. 30, 2014

(65) Prior Publication Data

US 2016/0215491 A1 Jul. 28, 2016

(30) Foreign Application Priority Data

Apr. 22, 2013 (GB) ..... 1307195.6

(51) Int. Cl.
*E04B 1/00* (2006.01)
*E04B 1/35* (2006.01)
*E04B 1/24* (2006.01)

(52) U.S. Cl.
CPC ..... *E04B 1/003* (2013.01); *E04B 1/35* (2013.01); *E04B 2001/2409* (2013.01)

(58) Field of Classification Search
CPC ..... E04B 1/003; E04B 1/0038; E04B 1/35; E04B 2001/2409
(Continued)

(56) References Cited

U.S. PATENT DOCUMENTS 4,295,571 A * 10/1981 Meyer ..... B42F 15/0094 108/118
4,660,331 A * 4/1987 Dahlen ..... E04B 5/43 52/283
(Continued)

FOREIGN PATENT DOCUMENTS

DE 3114486 10/1982
DE 102012103467 * 10/2013 ..... E04B 1/003
(Continued)

OTHER PUBLICATIONS

Machine translation of DE 102012103467 A1 obtained from https://patentscope.wipo.int/search/en/detail.jsf?docId=DE105047362&redirectedID=true (last accessed on Jun. 7, 2016).*
(Continued)

*Primary Examiner* — Theodore V Adamos
(74) *Attorney, Agent, or Firm* — Calfee, Halter & Griswold LLP

(57) ABSTRACT

The present invention provides for a novel balcony, a kit and a method of attaching a balcony to a building or existing construction. One aspect of the invention provides a balcony for attachment to an existing construction, the existing construction have a plurality of stubs fitted thereto, each stub having a first engagement portion, the balcony having a plurality of second engagement portions on one side of the balcony wherein the first and second engagement portions are arranged to engage with each other so as to cause the weight of the balcony to be supported by the existing construction and the balcony to be securely attached to the construction.

20 Claims, 2 Drawing Sheets

(58) Field of Classification Search
USPC ..... 52/73
See application file for complete search history.

(56) References Cited

U.S. PATENT DOCUMENTS

| | | | | | |
|---|---|---|---|---|---|
| 4,953,339 | A * | 9/1990 | Jewell | E04B 1/003 | 248/300 |
| 5,201,156 | A * | 4/1993 | Newman | E04H 17/14 | 52/299 |
| 5,210,988 | A * | 5/1993 | Shaifer | E04B 5/02 | 52/223.7 |
| 5,603,134 | A * | 2/1997 | Whipkey | E01D 15/133 | 14/2.4 |
| 6,363,671 | B1 * | 4/2002 | O'Mara | E04B 5/04 | 52/223.7 |
| 6,427,391 | B1 * | 8/2002 | Lyons | E04B 1/003 | 52/236.6 |
| 2006/0207214 | A1 * | 9/2006 | Keilaf | E04B 1/003 | 52/745.2 |
| 2012/0174528 | A1 * | 7/2012 | Fritschi | E04B 1/003 | 52/745.21 |
| 2012/0240481 | A1 * | 9/2012 | Ingalls | E04B 1/003 | 52/73 |
| 2014/0053473 | A1 * | 2/2014 | Bradly | E04B 5/02 | 52/73 |
| 2014/0215956 | A1 * | 8/2014 | Smith | E04B 1/003 | 52/705 |

FOREIGN PATENT DOCUMENTS

| | | | | |
|---|---|---|---|---|
| EP | 1477400 | | 11/2004 | |
| EP | 1712706 | A2 * | 10/2006 | E04B 1/003 |
| EP | 2261430 | | 12/2010 | |
| GB | 2514164 | A * | 11/2014 | E04B 1/003 |
| JP | 0681462 | | 3/1994 | |
| JP | 10266332 | | 10/1998 | |
| JP | 2002021177 | | 1/2002 | |
| WO | WO 2013122478 | A1 * | 8/2013 | E04B 1/003 |

OTHER PUBLICATIONS

Maine Deck Bracket, "Maine Deck Bracket Installation Instructions," (Apr. 2000), http://www.deckbracket.com/printable.html# (last visited Jan. 5, 2017).*

GB1307195.6 Search Report, UK IPO, dated Feb. 21, 2014.

PCT/GB/2014/051240, International Search Report and Written Opinion; dated Jun. 26, 2014.

* cited by examiner

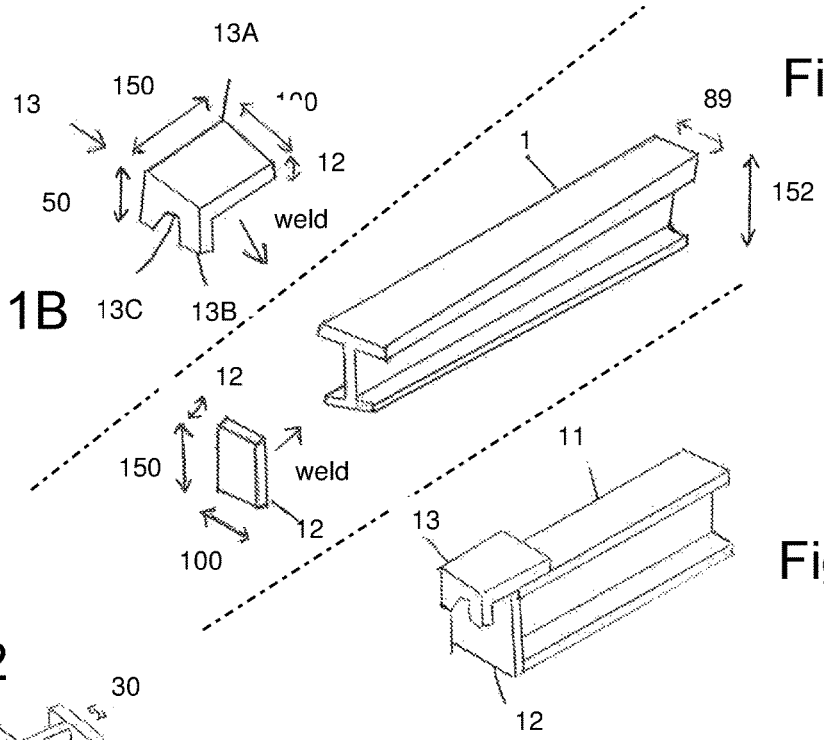
Fig. 1A
Fig. 1B
Fig. 1C
Fig. 2
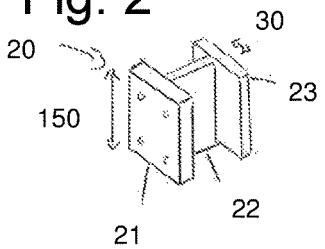
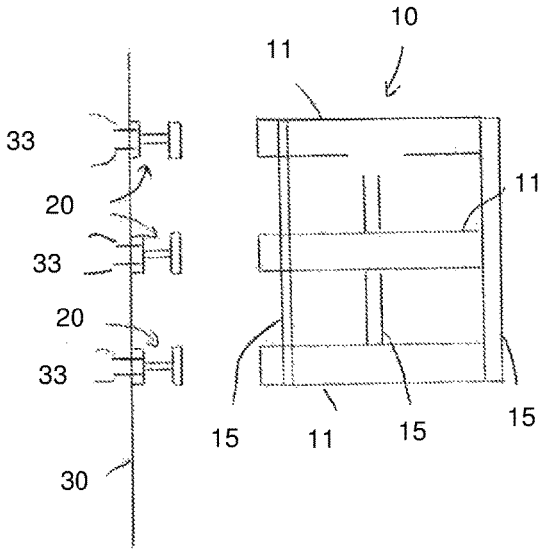
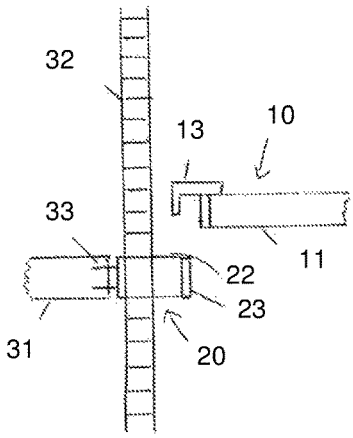
Fig. 3A
Fig.3B

BALCONY

CROSS REFERENCE TO RELATED APPLICATIONS

The present application is a national phase entry under 35 U.S.C. § 371 of, and claims priority to, International Application No. PCT/GB2014/051240 (WO2014/174269) filed on 22 Apr. 2014, entitled BALCONY, which claims the benefit of GB 1307195.6, filed on 22 Apr. 2013, the entire disclosures of which are fully incorporated herein by reference.

FIELD OF THE INVENTION

The present invention relates to a balcony and to a method of fitting a balcony to a building or other structure.

BACKGROUND OF THE INVENTION

Metal balconies are often specified in the plans drawn up by architects for new or existing buildings. These balconies may be decorative, but in many cases must be structurally secure and capable of supporting the load of several people as well as the furniture (balustrades, panels, handrails, etc.) needed to make the balcony safe.

In existing building approaches, a metalworker will generally attend the site to bolt 'stubs' onto/into the concrete frame while the basic structure of the building is being constructed. At a later stage, often after the main structure of the building, including brickwork and windows is complete, a frame for the balcony is manufactured off site from mild steel, galvanised and transported to site. The balcony frame is then lifted by crane and hold aloft adjacent to the stubs whilst the frame is firstly aligned with the stubs and then bolted onto them by workers working underneath or adjacent the loose balcony.

Whilst this method has been followed for many years and produces acceptable results, there are a number of problems with this process.

Firstly, there is a safety risk for the workers who are aligning the balcony and bolting it in place. These workers normally have to either work from either an elevated platform (a "cherry picker"), or on a scaffold tower from the ground level or the floor below. There is inevitably a risk of falling associated with such work at height. Furthermore there are risks associated with the manual handling of trying to push the balcony into position, and a risk of trapping hands and fingers when trying to get the balcony into position and bolted on. These risks are increased because of the length of time it takes to fix a balcony using this method (see below).

Secondly, it takes a substantial amount of time to install each balcony using this method. The crane has to stay in position supporting the balcony in mid-air while the workers align and bolt the balcony firmly in place. The workers then have to move all their access equipment and tools up to the next floor or balcony location before they can start the next one. As a result, the delivery driver also has to stay on site whilst each of the balconies is lifted into position one at a time through the day.

Thirdly, the resulting balconies are far from ideal in terms of their appearance, or alternatively require additional work on site to improve their appearance. Due to the need for the workers installing the balcony to have access to both the bolts and the nuts in order to secure the balcony to the building, the plates through which the bolts pass to secure the balcony to the building have to project out from the building line so they can be accessed from both sides. This means the plates and bolts are usually visible from beneath the finished balcony which does not look very good. In order to address this problem, balconies can have a soffit fitted underneath them, such as timber or metal cladding. However since access is required during the installation process to the bolts and nuts which will be hidden by such a soffit, the soffit has to be retrofitted to the balcony once all the bolts are tightened, which takes up more on site time.

The present invention aims to address one or more of the above problems with existing balcony construction and fitting processes.

SUMMARY OF THE INVENTION

Accordingly, at their broadest, aspects of the present invention provide a method of attaching a balcony to a building or other construction by dropping or sliding the balcony onto pre-fitted stubs, a balcony which is configured to be attached by dropping or sliding onto pre-fitted stubs and a kit comprising such a balcony and corresponding stubs.

A first aspect of the present invention preferably provides a balcony for attachment to an existing construction, the existing construction have a plurality of stubs fitted thereto, each stub having a first engagement portion, the balcony having a plurality of second engagement portions on one side of the balcony wherein the first and second engagement portions are arranged to engage with each other so as to cause the weight of the balcony to be supported by the existing construction and the balcony to be securely attached to the construction.

Preferably when the second engagement portions engage with the first engagement portions, no further connections are necessary in order to secure the balcony to the building or construction and so the process can be simple and quick.

In one embodiment, the second engagement portions are generally hook-shaped and the first engagement portions are configured to receive the second engagement portions such that the balcony can be lowered onto the stubs and securely attached to the construction.

In this manner the balcony can be lowered from above the stubs so as to "hook on" to the stubs and connect the balcony securely to the building. A lowering operation from a crane or similar structure is a very simple operation and the human input required in the operation may be limited to the operation of the crane and the guiding of the engagement portions together to secure the balcony. This can result in a very quick operation to attach the balcony to the building.

The balcony of this embodiment preferably has a framework structure and the second engagement portions comprise a projecting hook attached to that framework. For example, the projecting hook may be welded to the framework.

The projecting hook may include a first member which is attached to the framework and a second member which forms the hook. More preferably the first and second members may be arranged substantially at right angles to each other. For example, the projecting hook may be substantially L shaped in profile when viewed from the side of the balcony.

In certain configurations, the hook can be formed of two or more projecting portions with a recessed portion between them.

In another embodiment the first engagement portions comprise one or more projections from the stubs and the second engagement portions comprise one or more apertures or cavities in the structure of the balcony which are configured so as to receive the projections such that the balcony can be slid substantially horizontally onto the stubs by sliding the apertures or cavities onto the projections.

In this manner the balcony can be suspended level with the desired level of installation and the stubs and then "slid on" to the stubs. This type of balcony may be preferred for larger or heavier balconies where a greater rotational moment of the balcony is required to be supported by the stubs.

In a particularly advantageous configuration of this embodiment, the balcony may have a framework structure and the apertures or cavities are formed as part of the framework structure. This may allow the balcony to be constructed with a hollow frame which then provides for the cavities as part of that frame. Alternatively, apertures can be provided in the frame which can be slid over the projections. In one configuration, apertures can be provided in a plurality of parts of the frame which each run substantially perpendicular to the projections such that the turning moment of the balcony can be supported.

A second aspect of the present invention provides a kit including a balcony according to the above first aspect (including some, all or none of the optional or preferred features of that aspect) and the plurality of stubs.

The kit of the second aspect preferably provides a complete kit for the assembly of a balcony on the exterior of an existing construction or a building under construction.

At its broadest, a third aspect of the present invention provides a method of attaching a balcony to a building other construction wherein the balcony can be "dropped on", "slid on" or otherwise engaged with components secured to the construction, preferably without the need for detailed or complex attachment processes.

Preferably the third aspect provides a method of attaching a balcony to a building or other existing construction, the method comprising the steps of: fitting a plurality of stubs to the existing construction, each stub having at least one first engagement portion; attaching a balcony having a plurality of second engagement portions on one side of the balcony to the building by causing said second engagement portions to engage with the first engagement portions such that the weight of the balcony is supported by the stubs and the balcony is securely attached to the construction.

By fitting the plurality of stubs to the building in advance of attaching the balcony, only minor work is required for the attachment of the stubs to the construction and once the stubs have been fitted, the balcony can be simply, quickly and easily attached to the stubs to form a secure attachment. This may allow for short installation times when the balcony itself is delivered to site and preferably also avoid the need for lengthy, difficult and/or complex connection processes when attaching the balcony to the building.

In one embodiment, the second engagement portions are generally hook-shaped, the first engagement portions are configured to receive the second engagement portions and the step of attaching includes lowering the balcony from a position and vertically above the stubs so that the hook-shaped engagement portions engage with the first engagement portions of the stubs.

In this embodiment, the balcony can be lowered from a crane or similar arrangement to immediately engage by "hooking on" to the stubs. Preferably when the second engagement portions engage with the first engagement portions, no further connections are necessary in order to secure the balcony to the building or construction and so the process can be simple and quick.

In another embodiment, the first engagement portions comprise one or more projections from the stubs and the second engagement portions comprise one or more apertures or cavities in the structure of the balcony which are arranged to receive the projections and the step of attaching includes suspending the balcony such that it is substantially vertically aligned with the stubs and sliding the apertures or cavities over the projections.

In this embodiment, the balcony can be suspended from a crane or similar arrangement and then "slid on" to the stubs in a substantially horizontal motion. Preferably when the second engagement portions engage with the first engagement portions, no further connections are necessary in order to secure the balcony to the building or construction and so the process can be simple and quick.

The method of the present aspect may include any combination of some, all or none of the above described preferred and optional features.

The method of the present aspect is preferably implemented with a balcony according to the first aspect of this invention, as described above, or a kit according to the second aspect of this invention, as described above, but need not be.

BRIEF DESCRIPTION OF THE DRAWINGS

Embodiments of the invention will now be described by way of example with reference to the accompanying drawings in which:

FIGS. 1*a*-1*c* show perspective views of part of a balcony according to an embodiment of the present invention;

FIG. 2 shows a perspective view of a stub which forms part of an embodiment of the present invention;

FIGS. 3*a* and 3*b* show, respectively, a plan view and a side view of the installation of a balcony according to an embodiment of the present invention.

DETAILED DESCRIPTION

Figure 4:
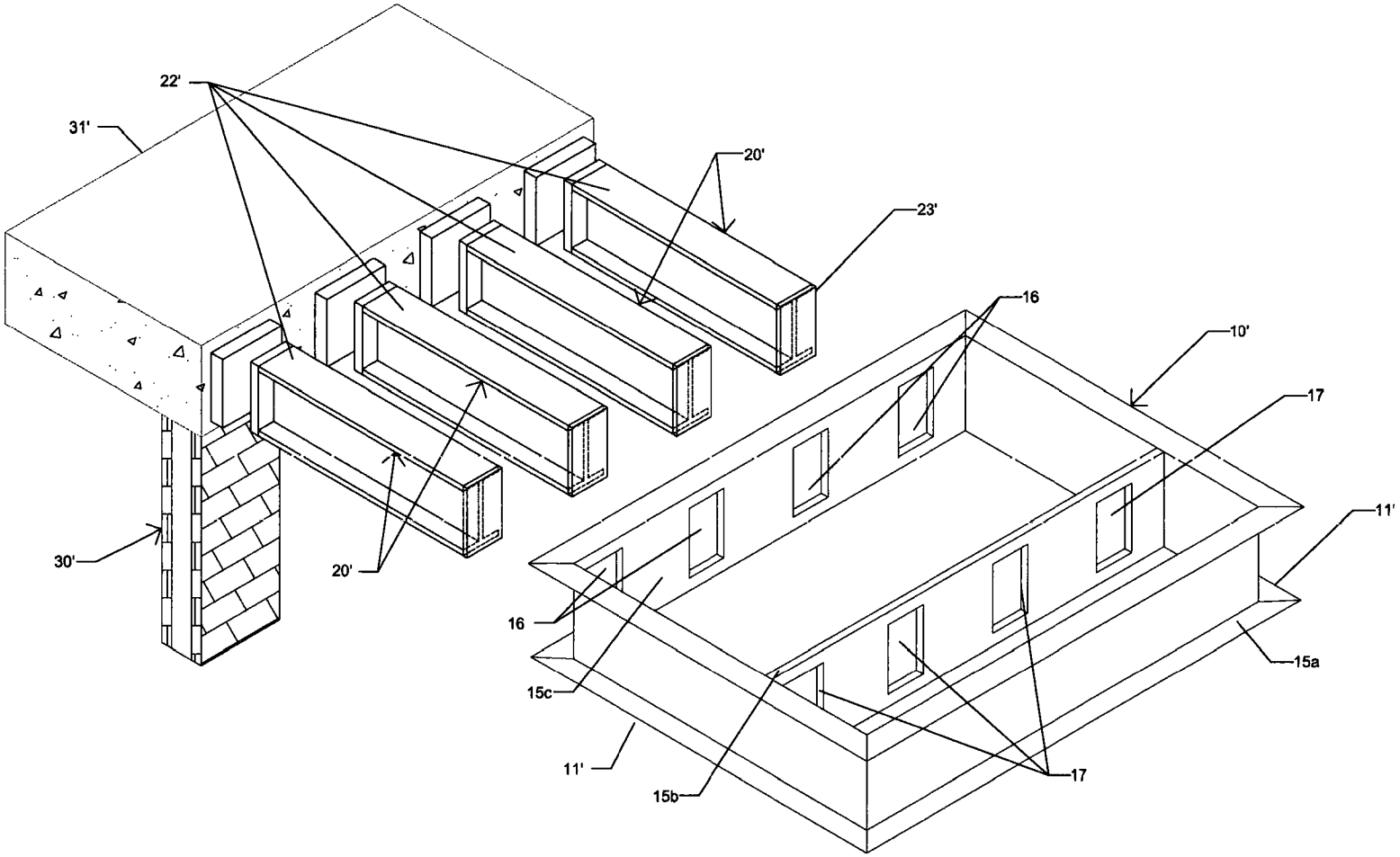
FIG. 4 shows a perspective view of a balcony according to an embodiment of the present invention.

FIGS. 1*a*-1*c* show perspective views of part of the framework of a balcony according to an embodiment of the present invention and the formation of a hook-shaped engagement portion on that part of the framework.

FIG. 1*a* shows a steel arm 11 which forms part of the main structure of the balcony. The arm 11 is made from 152×89 UB section (an I-shaped beam). As usual, it has a back plate 12, typically sized 100 mm wide×150 mm high×12 mm thick, welded to the end of it.

A hook-shaped engagement portion 13, shown in FIG. 1*b*, which is a piece of 150×50×12 mm steel angle cut 100 mm long is then welded to the arm 11 and the back plate 12 around 3 sides, to form a hook.

The hook-shaped portion 13 has a first part 13*a* which is configured to provide a connection to the arm 11 and a second part 13*b* which is substantially at right angles to the first part. In the centre of this second part 13*b*, a tapered notch 13*c* is cut (for example using a plasma cutter). This notch helps to guide the balcony into position on the stubs and also acts to stop it from moving sideways when attached.

FIG. 2 shows a stub 20 itself will be made from steel plates welded together to form an H-shaped construct. A first plate 21 of the stub is provided with mounting holes through which bolts can pass to secure the stub 20 to a building. The stub 20 of FIG. 2 is shown with four mounting holes, but it will be appreciated that more or fewer mounting holes may be provided depending on the size of the stub and the size of balcony to be supported.

The stub 20 has a fin 22 which projects from the building. In this embodiment the fin 22 is 150 mm high×30 mm thick. To the end of the fin 22 is welded a plate 23 which is typically the same size as the back plate 12 on the end of the balcony arm 11.

FIGS. 3*a* and 3*b* show the typical layout of the balcony 10 and stubs 20 in plan view and side view respectively. In FIG. 3*a* a typical balcony 10 with area dimensions of 3 m×1.2 m is shown which has a generally lattice structure of three arms 11 (which are configured as set out in FIG. 1 above) and three cross beams 15. These arms 11 and cross beams 15 support a floor structure (not shown) and may also be encased on the underside e.g. for aesthetic reasons.

As shown in FIG. 3*a*, the stubs 20 are attached to the wall of the building 30, for example using bolts 33, and each stub is located so as to engage with the hook 13 of one of the arms of the balcony. The balcony shown in FIG. 3 has three arms, three hooks and therefore three stubs are affixed to the building. However, it will be appreciated that any number and configuration of hooks, arms and stubs can be chosen depending on the specific installation, for example depending on the configuration and construction of the balcony, the weight and moment of the balcony to be supported and the dimensions of the stubs and hooks.

As shown in FIG. 3*b*, the balcony 10 is attached to the building 30 by simply lowering the balcony from a position above the stubs 20 so that the hooks 13 engage with the fin 22 and outer plate 23 of the stubs, thereby securing the balcony to the building by supporting both its weight and its turning moment. This process is, compared to the prior art processes described above, simple in terms of labour in that, apart from the operation of the crane to lower the balcony, human input is only required to guide the hooks 13 onto the stubs 20 and no further fixing operations are required.

As shown in FIG. 3*b*, the stub 20 can be connected to the concrete frame 31 of the building whilst the exterior brickwork (or other cladding material) can be built around the stub, thereby potentially hiding or disguising the connection of the stubs to the building.

FIG. 4 shows a perspective view of a balcony 10' according to a second embodiment of the present invention in position for mounting on a building 30'. Only the frame of the balcony 10' is shown in FIG. 4, as the deck that would normally form the upper surface of the balcony has been omitted to show the internal structure of the balcony. Similarly, the balcony would usually have a lower surface such that the internal structure of the balcony frame that is shown in FIG. 4 would not normally be visible from below.

As with the first embodiment described above, stubs 20' are attached to the wall of the building 30', for example using bolts (which are not shown in FIG. 4 as they are covered by cladding 31'). In the embodiment shown there are four stubs 20'. Again, it will be appreciated that any number and configuration of hooks, arms and stubs can be chosen depending on the specific installation, for example depending on the configuration and construction of the balcony, the weight and moment of the balcony to be supported and the dimensions of the stubs and hooks.

In the embodiment shown in FIG. 4, the stubs 20' are identically constructed from 152×89 mm I-beam steel 22' to which an end plate 23' has been welded.

The frame of the balcony 10' shown in FIG. 4 is of an open lattice type structure, in this case manufactured from 200×90 mm parallel flange channel (PFC) steel. The balcony has two arms 11' forming the left and right sides of the frame when viewed facing the building which are connected by three cross beams 15*a*, 15*b* and 15*c*.

A first of these cross beams 15*a* forms the front edge of the frame when viewed facing the building and is a simple metal beam.

A second of these cross beams 15*c* forms the rear edge of the frame when viewed facing the building and has four apertures 16 which are sized and positioned so as to permit each of the stubs 20' to pass through the apertures with a small clearance. The degree of clearance is generally chosen as a trade-off between a) providing for easier installation by requiring less precision in the installation process and a degree of tolerance for the attachment of the stubs 20' to the building 30' and b) providing a snug fit for the balcony 10' in its fitted position.

The third cross beam 15*b* is positioned parallel to and intermediate the other two cross beams 15*a*, 15*c*. This cross beam 15*b* also has four apertures 17 corresponding to those in the second cross beam 15*c* and likewise sized and positioned so as to permit each of the stubs 20' to pass through with a small clearance.

The position of the third cross beam 15*b* relative to the other cross beams 15*a*, 15*c* is chosen depending on the weight and turning moment of the balcony (and its anticipated load) so as to provide a secure and stable support for the balcony through the engagement between the second and third cross beams and the stubs 20'. It will therefore be appreciated that for lighter balconies, the stubs 20' can be made shorter and the second cross beam 15*b* positioned closer to the third cross beam 15*c*, and for heavier balconies it may be preferred that the stubs 20' are of similar dimensions to the arms 11', and in some variants, the first cross beam 15*a* could also have apertures formed in it, such that the stubs engage with this cross beam as well. In such configurations, the second cross beam 15*b* could be provided midway between the other cross beams, or could be omitted entirely.

For installation, the balcony 10' is suspended from a crane in a position such that the apertures 16 are level with the stubs 20' and adjacent thereto (i.e. in the position shown in FIG. 4). The balcony 10' is then attached to the building 30' by moving the balcony horizontally so that the stubs 20' pass through the apertures 16 and 17 thereby securing the balcony to the building by supporting both its weight and its turning moment. This process is, compared to the prior art processes described above, simple in terms of labour in that, apart from the operation of the crane to lower the balcony, human input is only required to guide the stubs 20' into the apertures 16 as the balcony is moved towards the building and no further fixing operations are required.

In a further embodiment of the present invention, which is not illustrated in the Figures, but which is similar to the second embodiment described above, the arms of the balcony structure provide the "apertures" by having a cross-section (as viewed from the building) which substantially matches that of the stubs, such that the balcony can be installed by sliding the arms over the stubs.

Although the embodiments of the invention described above have been set out with precise dimensions it will be apparent to the skilled person that these dimensions are purely illustrative of specific embodiments of the present invention and that the dimensions can be varied depending on the configuration of the balcony desired without departing from the scope of the present invention.

The invention claimed is:

1. A balcony for attachment to an existing construction, the balcony having a structure, the existing construction have a plurality of stubs fitted thereto, the stubs being configured to support the full weight of the balcony without any need for fastening when the balcony is rested on the plurality of stubs, each stub having at least one first engagement portion comprising one or more projections, and the balcony having:

a plurality of second engagement portions comprising one or more apertures in the structure of the balcony which are configured so as to receive the one or more projections, with the one or more projection receiving apertures only on one side of the structure of the balcony; and a plurality of third engagement portions configured to engage the plurality of stubs, such that the balcony can be slid substantially horizontally onto the stubs by sliding the one or more apertures onto the one or more projections, so as to cause the weight of the balcony to be entirely supported in a vertical direction without any need for fastening by the existing construction and the balcony to be securely attached to the construction;

wherein the balcony has a framework structure and the one or more apertures of the second engagement portions are formed as part of the framework structure; and further wherein the framework structure includes:

a first cross-beam which is substantially perpendicular to the one or more projections and the one or more apertures of the second engagement portions comprise one or more apertures through said first cross-beam and a second cross-beam which is substantially perpendicular to the one or more projections, wherein the second cross-beam is inside an inner perimeter of the framework structure and spaced from the inner perimeter of the framework structure in a direction parallel to the one or more projections with a hollow space between a distal surface of the one side of the structure of the balcony and a proximal surface of the inner cross beam, and the second cross-beam provides the third engagement portions.

2. The balcony according to claim 1, wherein the third engagement portions comprise one or more apertures through said second cross-beam.

3. A balcony for attachment to an existing construction, the balcony having a structure, the existing construction have a plurality of stubs fitted thereto, the stubs being configured to support the full weight of the balcony without any need for fastening when the balcony is rested on the plurality of stubs, each stub having at least one first engagement portion comprising one or more projections, and the balcony being provided as a hollow frame having a plurality of second engagement portions comprising one or more apertures in the structure of the balcony which are configured so as to receive the one or more projections, such that the balcony can be slid substantially horizontally onto the stubs by sliding the one or more stubs into the one or more apertures of the hollow frame, so as to cause the weight of the balcony to be supported by the existing construction and the balcony to be securely attached to the construction;

wherein the balcony has a framework structure and the one or more apertures of the second engagement portions are formed as part of the framework structure with the one or more projection receiving apertures only on one side of the framework structure;

wherein the weight of the balcony is entirely supported in a vertical direction by the stubs; and further wherein the framework structure further comprises an inner cross-beam which is substantially perpendicular to the one or more projections and the one or more apertures of the second engagement portions comprise one or more apertures through said inner cross-beam and wherein the inner cross-beam is inside an inner perimeter of the framework structure and spaced from the inner perimeter of the framework structure in a direction parallel to the one or more projections with a hollow space between a distal surface of the one side of the framework structure and a proximal surface of the inner cross beam.

4. A balcony for attachment to an existing construction, the balcony having a structure, the existing construction have a plurality of stubs fitted thereto, the stubs being configured to support the full weight of the balcony without any need for fastening when the balcony is rested on the plurality of stubs, each stub having at least one first engagement portion comprising one or more projections, and the balcony having a plurality of second engagement portions comprising one or more apertures in the structure of the balcony which are configured so as to receive the one or more projections, such that the balcony can be slid substantially horizontally onto the stubs by sliding the one or more apertures onto the one or more projections, so as to cause the weight of the balcony to be supported by the existing construction and the balcony to be securely attached to the construction;

wherein the balcony has a framework structure and the one or more apertures of the second engagement portions are formed as part of the framework structure, with the one or more projection receiving apertures only on one side of the framework structure;

wherein the stubs extend over half a depth of the balcony in a direction parallel to the one or more projections; and wherein the weight of the balcony is entirely supported in a vertical direction by the stubs;

wherein the framework structure further comprises an inner cross-beam which is substantially perpendicular to the one or more projections and the one or more apertures of the second engagement portions further comprise one or more apertures through said inner cross-beam; and wherein the inner cross-beam is inside an inner perimeter of the framework structure and spaced from the inner perimeter of the framework structure in the direction parallel to the one or more projections with a hollow space between a distal surface of the one side of the framework structure and a proximal surface of the inner cross beam.

5. The balcony according to claim 4, wherein the framework structure comprises first and second cross-beams which are substantially perpendicular to the one or more projections and the second engagement portions comprise one or more apertures through said first and second cross-beams and wherein the second cross-beam is the inner cross-beam.

6. The balcony according to claim 3, wherein the first cross-beam having the one or more apertures forms part of the framework structure.

7. The balcony according to claim 3, wherein each first engagement portion comprises a plurality of projections, wherein the second engagement portion of said first and second cross-beams comprises a plurality of apertures, and wherein the first cross-beam having the plurality of apertures forms part of the framework structure.

8. The balcony according to claim 3, wherein each first engagement portion comprises a plurality of projections, wherein the second engagement portion of said first and second cross-beams comprises a plurality of apertures, wherein corresponding apertures in said first and second cross-beams are aligned, and wherein the first cross-beam having the plurality of apertures forms part of the framework structure.

9. The balcony according to claim 4, wherein each first engagement portion comprises a plurality of projections and wherein the second engagement portion of the inner cross-beam comprises a plurality of apertures.

10. A kit comprising:

a balcony for attachment to an existing construction, the existing construction have a plurality of stubs fitted thereto, the stubs being configured to support the full weight of the balcony without any need for fastening when the balcony is rested on the plurality of stubs, each stub having at least one first engagement portion comprising one or more projections, and the balcony being provided as a hollow frame having a plurality of second engagement portions comprising one or more apertures in the hollow frame structure of the balcony which are configured so as to receive the one or more projections, such that the balcony can be slid substantially horizontally onto the stubs by sliding the one or more apertures onto the one or more projections, so as to cause the weight of the balcony to be supported by the existing construction and the balcony to be securely attached to the construction; wherein the balcony has a framework structure and the one or more apertures of the second engagement portions are formed as part of the framework structure, with the one or more projection receiving apertures only on one side of the framework structure; wherein the weight of the balcony is entirely supported in a vertical direction by the stubs; and further wherein the framework structure further comprises an inner cross-beam which is substantially perpendicular to the one or more projections and the one or more apertures of the second engagement portions comprise one or more apertures through said inner cross-beam; and the plurality of stubs, the stubs being configured to support the full weight of the balcony without any need for fastening when the balcony is rested on the plurality of stubs; and wherein the inner cross-beam is inside an inner perimeter of the framework structure and spaced from the inner perimeter of the framework structure in a direction parallel to the one or more projections with a hollow space between a distal surface of the one side of the framework structure and a proximal surface of the inner cross beam.

11. The kit according to claim 10, wherein the framework structure comprises first and second cross-beams which are substantially perpendicular to the projections and the second engagement portions comprise one or more apertures through said first and second cross-beams and wherein the second cross-beam is the inner cross-beam.

12. The kit according to claim 11, wherein the first cross-beam having the plurality of apertures forms part of the framework structure.

13. The kit according to claim 11, wherein each first engagement portion comprises a plurality of projections, wherein the second engagement portion of said first and second cross-beams comprises a plurality of apertures, and wherein the first cross-beam having the plurality of apertures forms part of the framework structure.

14. The kit according to claim 11, wherein each first engagement portion comprises a plurality of projections, wherein the second engagement portion of said first and second cross-beams comprises a plurality of apertures, wherein corresponding apertures in said first and second cross-beams are aligned, and wherein the first cross-beam having the plurality of apertures forms part of the framework structure.

15. The kit according to claim 10, wherein each first engagement portion comprises a plurality of projections and wherein the second engagement portion of the inner cross-beam comprises a plurality of apertures.

16. A method of attaching a balcony to a building or other existing construction, the method comprising the steps of:

fitting a plurality of stubs to the building or other existing construction, the stubs being configured to support the full weight of the balcony without any need for fastening when the balcony is rested on the plurality of stubs and each stub having at least one first engagement portion comprising a plurality of projections;

attaching the balcony to the building or other existing construction, a body of said balcony having:

a framework structure;

at least one cross-beam which is substantially perpendicular to the plurality of projections; and a plurality of second engagement portions comprising a plurality of apertures through said at least one cross-beam and through only one side of the framework structure; and wherein the at least one cross-beam is an inner cross-beam inside an inner perimeter of the framework structure and spaced from the inner perimeter of the framework structure in a direction parallel to the plurality of projections with a hollow space between a distal surface of the one side of the framework structure and a proximal surface of the inner cross beam; and wherein the step of attaching includes:

suspending the balcony such that the balcony is substantially vertically aligned with the plurality of projections; and sliding the plurality of apertures over the plurality of projections such that the weight of the balcony is entirely supported in a vertical direction by the stubs without any need for fastening, with the plurality of projections through the plurality of apertures, and the balcony is securely attached to the building or other existing construction.

17. The method according to claim 16, where the at least one cross-beam of the framework structure comprises first and second cross-beams which are substantially perpendicular to the plurality of projections and the second engagement portions comprise one or more apertures through said first and second cross-beams and wherein the second cross-beam is the inner cross-beam.

18. The method according to claim 17, wherein the second engagement portion of said first and second cross-beams comprises a plurality of apertures and wherein the first cross-beam having the plurality of apertures forms part of the framework structure.

19. The method according to claim 17, wherein the second engagement portion of said first and second cross-beams comprises a plurality of apertures, wherein corresponding apertures in said first and second cross-beams are aligned, and wherein the first cross-beam having the plurality of apertures forms part of the framework structure.

20. The method according to claim 16, wherein the second engagement portion of the at least one cross-beam comprises a plurality of apertures.

* * * * *